United States Patent [19]

Vassiliou

[11] Patent Number: 4,890,520

[45] Date of Patent: Jan. 2, 1990

[54] SELF ADJUSTING GRIPPING TOOL

[76] Inventor: Eustathios Vassiliou, 12 S. Townview La., Newark, Del. 19711

[21] Appl. No.: 293,707

[22] Filed: Jan. 5, 1989

[51] Int. Cl.[4] ..... B25B 7/04

[52] U.S. Cl. ..... 81/365; 81/393

[58] Field of Search ..... 81/318, 324, 385, 392, 81/393, 364, 365, 407, 413

[56] References Cited

U.S. PATENT DOCUMENTS

| | | | |
|---|---|---|---|
| 186,099 | 1/1877 | Barnes | 81/365 |
| 681,487 | 8/1901 | Quist . | |
| 1,271,911 | 7/1918 | Kearney . | |
| 1,408,524 | 3/1922 | Long . | |
| 1,528,247 | 3/1925 | Cruickshank . | |
| 1,625,615 | 4/1927 | Kuttes . | |
| 2,084,633 | 6/1937 | Erickson | 81/365 |
| 3,224,303 | 12/1965 | Giroux | 81/365 X |
| 3,261,243 | 7/1966 | Ellison | 81/351 |
| 3,354,759 | 11/1967 | Cook | 81/379 |
| 4,542,669 | 9/1985 | Roux | 81/418 |

*Primary Examiner*—D. S. Meislin

[57] ABSTRACT

A gripping tool acting as both a pair of pliers and a wrench self locks and self releases upon application or removal of gripping pressure, respectively.

34 Claims, 8 Drawing Sheets

SELF ADJUSTING GRIPPING TOOL

FIELD OF THE INVENTION

This invention relates to a self adjusting tool and more particularly to a gripping tool that adjusts and releases automatically upon application or removal of gripping pressure.

BACKGROUND OF THE INVENTION

Gripping tools usually take the form of either a pair of pliers or of an adjustable wrench depending on the particular job for which they are intended to perform.

A problem typical of pliers is that after they have gripped an article, the exerted pressure on the article continues to increase with sometimes deleterious results. Furthermore the gripping force of the jaws varies as a function of the gripping pressure on the handles of the pliers by the operator. An advantage of the pliers is that they are very easy and fast to attain an open or closed configuration, by simply opening or closing the handles.

On the other hand, adjustable wrenches do not attain the open or closed configuration nearly as easily and fast as pliers, and they do not have the gripping power of pliers, but they lock in a series of positions, thus avoiding the deleterious effects of uncontrollable excessive pressure.

The advantages and disadvantages of these gripping tools result mainly from the fact that the jaws of the pliers operate through a rotational motion around a pivot point, while in the case of the adjustable wrenches, the jaws move in a linear sliding mode. Many attempts have been made so far to attain the advantages and eliminate the disadvantages of both mechanisms in a single tool without success.

One category of such attempts, represented for example by U.S. Pat. No. 4,542,669, involves the so-called "vise grip pliers", the mechanisms of which are based on the "over the center" principle. These tools have the disadvantage that their jaws have to be brought first to close proximity to the size of the article to be gripped, usually through a screw mechanism, and then brought to the final gripping position by energizing the "over the center mechanism" as a second operation. In addition, a separate lever has to be pressed at the end of the operation for releasing the gripping force.

To avoid the necessity of the initial step, Ellison (U.S. Pat. No. 3,261,243) uses a rachet/toggle clamp, which engages as an "over the center" position is approached. However, an additional separate lever has to be pressed again for releasing the gripping force.

Another type of adjustable wrenches, which however, also lack the advantages of pliers, since among other problems both hands of the operator have to be employed for their use, are described for example in U.S. Pat. Nos. 681,487 and 1,408,524. Both employ engaging means in the form of two flat sets of teeth which engage each other to prevent further movement of the jaws after an article has been gripped thereinbetween.

In U.S. Pat. No. 1,528,247 there is shown a pair of pliers including a pin, which can be rotated to lock the jaws of the pliers in a limited number of predetermined positions. A somewhat improved version of this type of locking devices is shown in U.S. Pat. No. 1,271,911, where a pin is automatically inserted into a rachet mechanism during the gripping operation of the jaws.

However, this mechanism also lacks the continuum of locking positions needed for making this tool actually useful and practical. For one pin to counteract successfully the huge forces acting on it, it has to have sizeable dimensions, thus considerably limiting the number of locking positions.

None of the above inventions has given a satisfactory solution.

SUMMARY OF THE INVENTION

The present invention solves these vexing problems through a gripping tool comprising an assembly of:

(a) a first and a second member;

the first member comprising,

- a first substantially circular hub having a radius, a center, a center axis, and a perimeter,
- a first jaw extending from the perimeter of the first hub,
- a first handle also extending from the perimeter of the first hub in a direction generally opposite to the direction of the first jaw, and
- first engaging means located along the perimeter of the first hub, the second member comprising,

- a second hub having a center and a center axis substantially coinciding with the center axis of the first hub,
- a first interconnecting arm integrally connected to the second hub,
- a second jaw extending from the second hub in a direction generally opposite to the direction of the first interconnecting arm,
- a second handle extending away from the first interconnecting arm in a direction generally opposite to the direction of the second jaw, and
- second engaging means on the second handle along a concave curvature, the concave curvature being part of an arc of a circle of a radius substantially equal to the radius of the first hub, the second engaging means being complementary to the first engaging means, (b) first pivoting means having a center and a center axis for rotatably connecting the first and the second hubs through their center axes, whereby the handles are pivoted from an open to a forced closed configuration where the first and second jaws are substantially in contact with each other, (c) second pivoting means having a center and a center axis for rotatably connecting the second handle to the first interconnecting arm, and (d) first bias means for applying a first bias force between the first interconnecting arm and the second handle in order to maintain the second engaging means to a first position spaced away from the first engaging means, the first bias force selected such that upon application of a predetermined counter force to the first bias means, the second engaging means pivots to a second position and engages the first engaging means preventing any relative movement of the first and second members until such time as the predetermined force is removed from the first bias means, the first and second positions of the second engaging means being the limits of a continuum of intermediate positions located on a continuum of arcs of a first set of circles having radii equal to the radius of the first hub and centers lying on the perimeter of a second circle having as center the center of the second pivoting means and radius the distance between the centers of the first and second pivoting means.

In an alternate embodiment the second hub is also circular, and the gripping tool further comprises:

third engaging means located along the perimeter of the second hub, a second interconnecting arm integrally connected to the first hub, fourth engaging means on the first handle along a concave curvature, the concave curvature being part of an arc of a circle having a radius equal to the radius of the second hub, third pivoting means having a center and a center axis for rotatably connecting the first handle to the second interconnecting arm, and second bias means for applying a second bias force between the second interconnecting arm and the first handle in order to maintain the fourth engaging means to a third position spaced away from the third engaging means, the second bias force selected such that upon application of a predetermined counter force to the second bias means, the fourth engaging means pivots to a fourth position and engages the third engaging means preventing any relative movement of the members until such time as the predetermined force is removed from the second bias means, the third and fourth positions of the fourth engaging means being the limits of a continuum of intermediate positions located on a continuum of arcs of a third set of circles having radii equal to the radius of the second hub and centers lying on the perimeter of a fourth circle having as center the center of the third pivoting means and radius the distance between the centers of the first and third pivoting means.

BRIEF DESCRIPTION OF THE DRAWINGS

The present invention will be best understood from the following description taken together with the accompanying drawings in which.

DETAILED DESCRIPTION OF THE INVENTION

Figure 1:
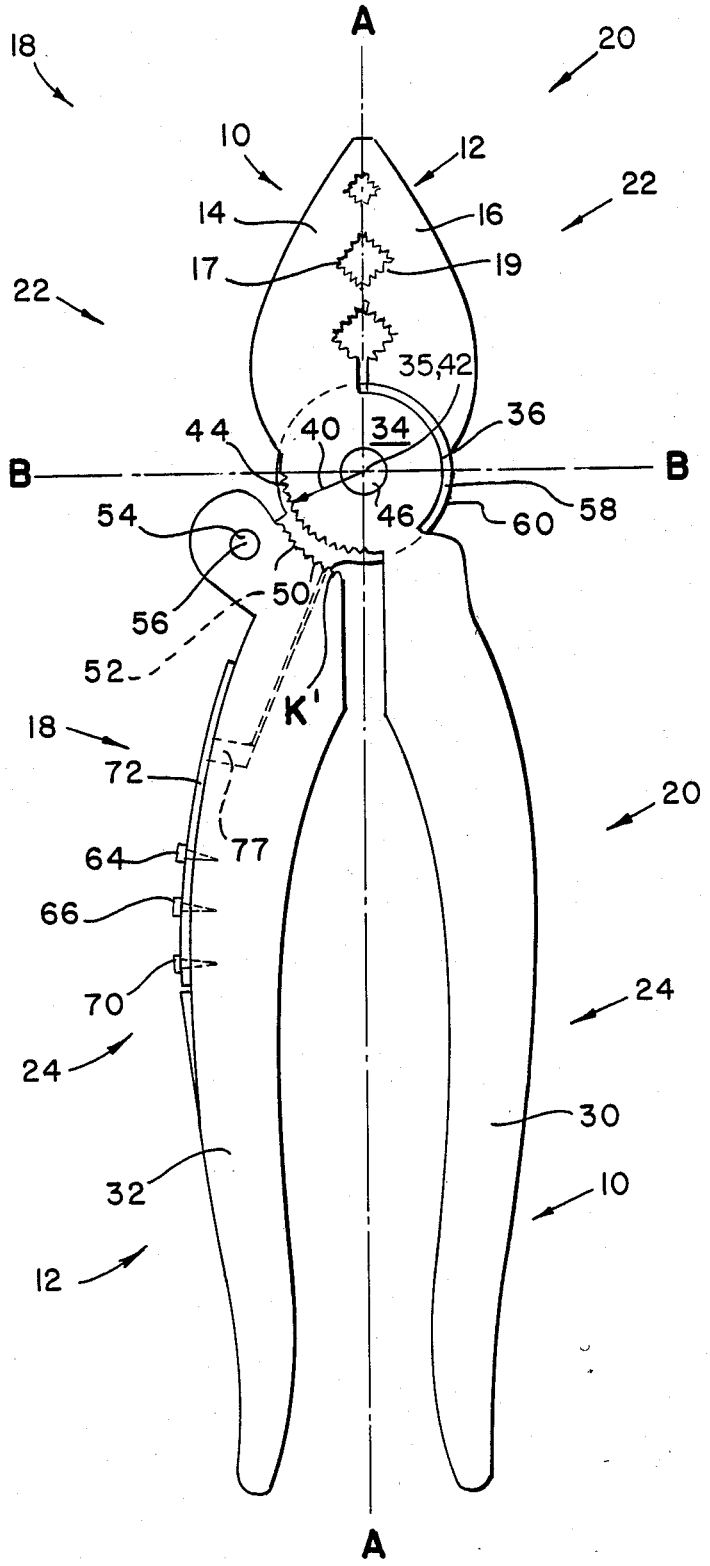
FIG. 1 shows a schematic representation of a top view of a gripping tool in the form of a pair of pliers in accordance with the present invention.

Referring now to FIGS. 1 to 4, there is depicted a gripping tool, such as a pair of pliers constructed in accordance with the present invention. The gripping tool depicted in these figures also represents the preferred embodiment contemplated by the inventor.

The pliers comprise an assembly of a first and a second member 10 and 12 respectively. The first member 10 includes a first handle 30 and a first jaw 14. The handle 30 and the jaw 14 are connected by a substantially circular first hub 34 and extend in generally opposite directions therefrom.

The first hub 34 has a radius 40, a center 35, a center axis 37 and a perimeter 36. Coaxial with the first hub 34, there is a hole 25 which is preferably conical in shape. Located along the perimeter 36 of the first hub 34, there is a first engaging means 44 which may be a frictional surface, or preferably a set of engaging teeth. A frictional surface is a surface which develops resistance in sliding over another surface, the resistance having a high enough value to immobilize the two surfaces with respect to each other within the range of conditions encountered in the operation of the tool. The teeth can be triangular, gear shaped, screw or nut thread shaped or have any other configuration, as long as they are orderly and equidistantly spaced with respect to each other. The part of the first hub containing the engaging means should be circular. However, the parts which do not contain engaging means may have any other shape, such as linear, angular, and the like. In such cases, the radius 40, center 35, center axis 37, and perimeter 36, belong to a circle, an arc of which is the engaging means 44.

The second member 12 has a somewhat more complicated structure. It includes a second jaw 16 extending from a second hub 58. A first interconnecting arm 52 also extends from the second hub 58 in a direction generally opposite to that of the second jaw 16. The second hub 58, which in this embodiment does not have to be circular as it contains no engagement means, also includes a center 49, a center axis 48, and a coaxial hole 26. Preferably, hole 26 is also conical in shape and sized so that when the two members 10 and 12 are assembled into a single unit, they form part of the same cone. A first pivoting means 46, which may be a pin, includes a center 47, and a center axis 43. The first pivoting means 46 is used to rotatably connect the two members 10 and 12 together. When a pin is employed as the first pivoting means 46, it is preferably conical in shape and sized to fit into the holes 26 and 25. Once inserted, the pin is secured in place by any of a number of well known ways in the art, such as press fitting on one hub and overlap fitting on the other hub or by nuts threaded to the pin ends, or a cotter pin inserted through a hole to the pin or other. It is only important that the two members be connected in a manner that allows free rotational movement to permit opening and closing of the jaws as the handles are opened and closed. Of course other pivoting means than a conical pin may be selected, such as cylindrical pin, a screw or the like. Evidently, depending on the nature, shape, and size of the first pivoting means 46, holes 25 and 26 have to have a matching shape and size.

The first interconnecting arm 52 includes a hole 76, also preferably conical in shape, which serves to attach the first interconnecting arm 52 to a second handle 32 extending away from the first interconnecting arm 52 in a direction generally opposite to the direction of the second jaw 16.

The second handle 32 includes a cutaway portion 77 into which nests the first interconnecting arm 52. Preferably the second handle 32 is shaped such as to match the shape of the first interconnecting arm 52, so that when the arm 52 is nesting in the cutaway portion, no part of the arm 52 extends outside of the second handle 32.

The part of the second handle 32 being above the cutaway portion 77 includes a hole 78, also preferably conical in shape and sized so that when the first interconnecting arm 52 and the second handle 32 are rotatably connected by a second pivoting means 54, holes 78 and 76 are parts of the same cone.

The second pivoting means 54, which may also be a pin, includes a center 56, and a center axis 45. The same comments cited in the case of the first pivoting means 46 and its relation to holes 25 and 26 apply also in the case of the second pivoting means 54 and its relation to holes 76 and 78.

A first bias means 72, which may be a leaf spring, is attached to the second handle 32 with one or more screws, such as screws 64, 66, and 70, to apply a first bias force to the first interconnecting arm 52. The first bias force may be adjusted by changing the position of the screw 64 closest to the contact point between the bias spring 72 and the interconnecting arm 52, as it is better illustrated in FIG. 3. The smaller the distance between the deflection area of the bias leaf spring 72 and its point of contact with the interconnecting arm 52, the higher the first bias force. It becomes then evident that any fastening arrangement that can hold the leaf spring close to the handle in a number or a continuum of predetermined positions in order to alter this distance, can be utilized to adjust the value of the first bias force. Actuation of such arrangement from the end of the handle is more convenient for the user of the tool, as better illustrated in FIG. 5 for a different embodiment of this invention.

The second handle 32 extends close to the first hub 34, where it terminates in a second engaging means 50 complementary to the first engaging means 44. The second engaging means 50 may also be a frictional surface or preferably a set of engaging teeth.

Figure 2:
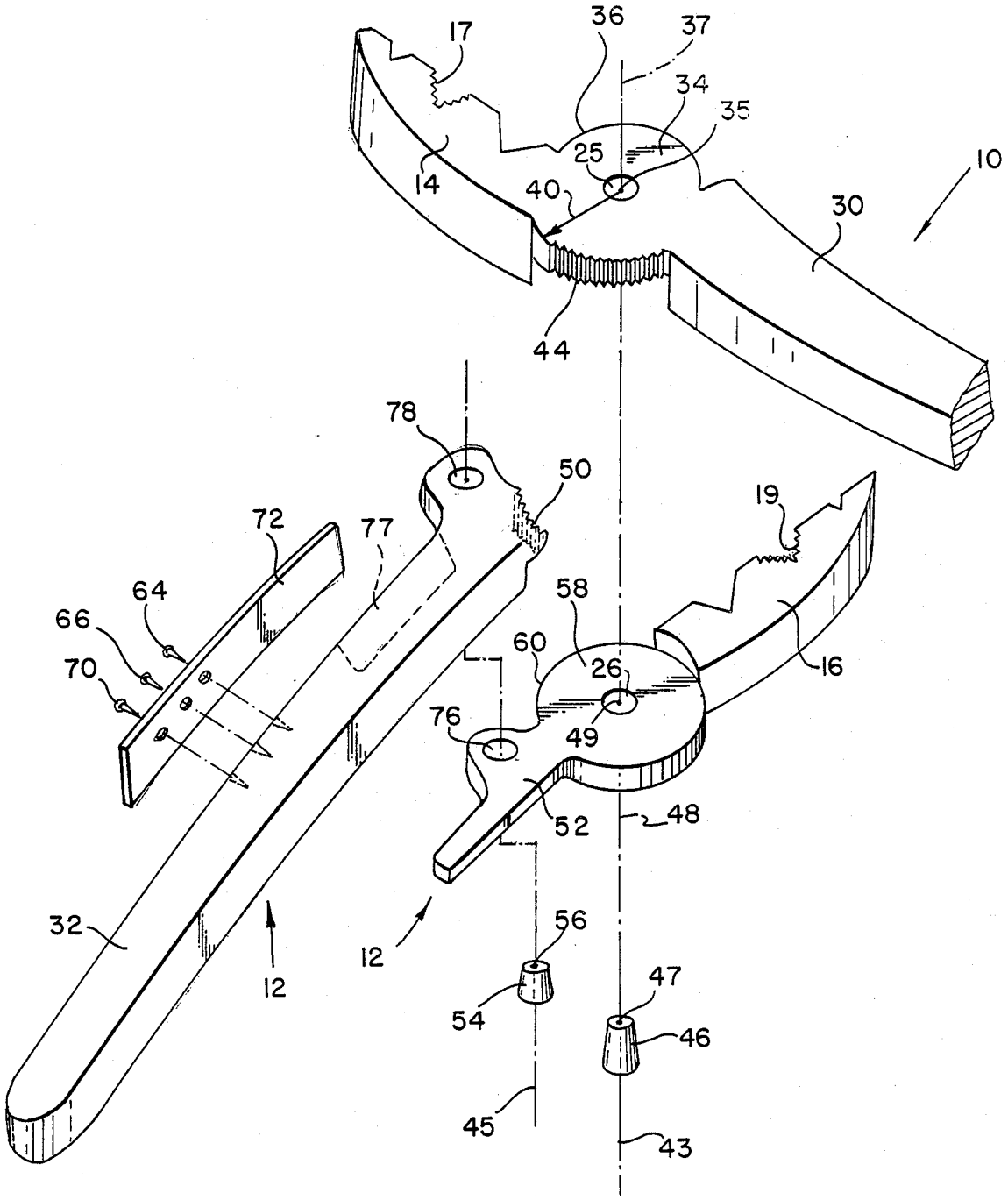
FIG. 2 shows a stylized perspective view of the different components of the pair of pliers in accordance with the embodiment of FIG. 1.
Figure 3:
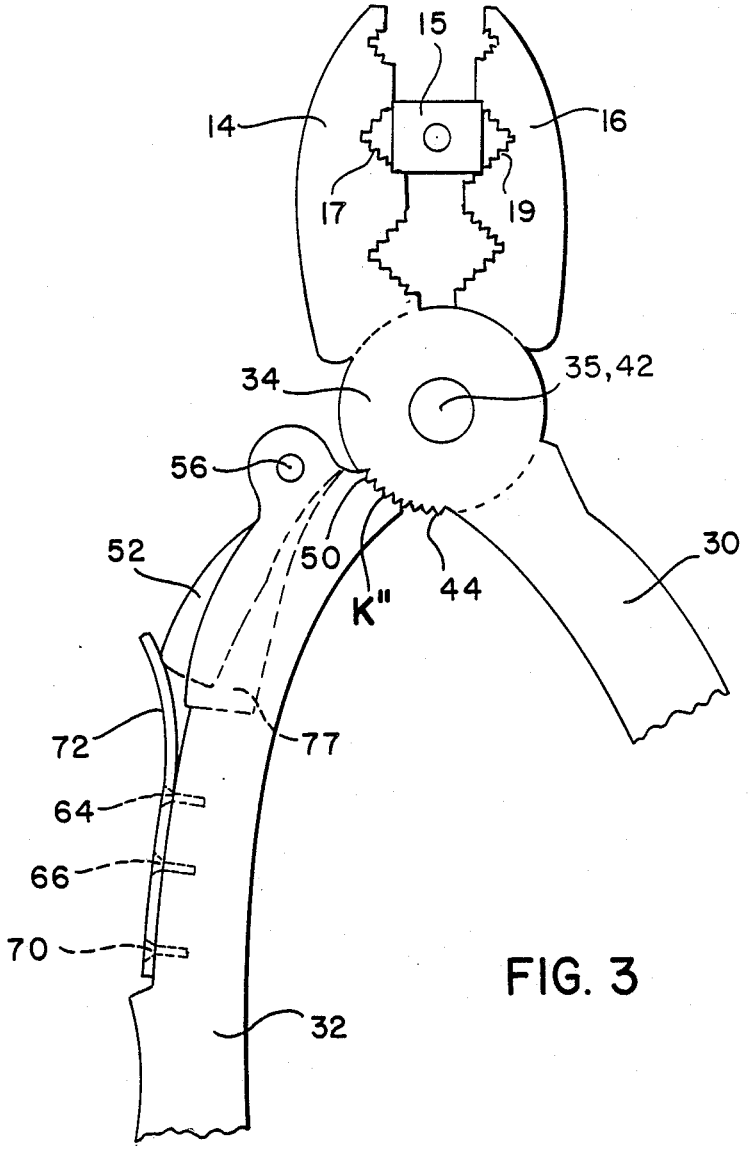
FIG. 3 shows a schematic representation of the pliers illustrated in FIG. 1 with the complementary engaging means in the engaged position.

Referring to FIG. 1, a common center point 42 is the projection of a plurality of centers and center axes, shown in detail in FIG. 2, on a plane perpendicular to the center axis of the first pivoting means. These include center 35 and center axis 37 of the first hub 34, center 49 and center axis 48 of the second hub 58, and center 47, and center axis 43 of the first pivoting means 46. Similarly, center 56, when the tool is assembled, coincides also with the projection of center axis 45 of pivoting means 54 on a plane perpendicular to center axis 45.

The gripping tool illustrated in FIG. 1 shows the tool in a free closed configuration, meaning that the first and second jaws 14 and 16 are closed or substantially in contact with each other, but no external gripping force has been applied on the handles 30 and 32, so that the second engaging means 50 is pivoted to a first position K' away from the first engaging means 44. Forced closed configuration is the configuration that the tool takes when the first and second jaws 14 and 16 are closed or substantially in contact with each other, and adequate gripping force has been applied on the first and second handles 30 and 32 to induce a predetermined counter force against the first bias force of the first bias means 72, and pivot the second engaging means 50 into a second position K", as better illustrated in FIG. 4, where the second engaging means 50 engages the first engaging means 44. When the second engaging means 50 is in position K", each of the first engaging means 44 and second engaging means 50 is said to be in an engagement mode. Similarly, a free open configuration implies that the first and second jaws 14 and 16 are open or not in contact with each other and no gripping force has been applied to the handles 30 and 32, so that the second engaging means 50 attains again a first position K' away from the first engaging means 44. Finally, the tool is considered to have a forced open configuration when the jaws 14 and 16 are open or not in contact with each other, usually separated by an object to be gripped, and an adequate gripping force has been applied to the handles 30 and 32 to induce a predetermined counter force against the first bias force of the first bias means 72 and pivot the second engaging means to a second position K", as better illustrated in FIG. 3, where the second engaging means 50 engages the first engaging means 44, and therefore, each of the engaging means 44 and 50 assumes an engagement mode.

Figure 4:
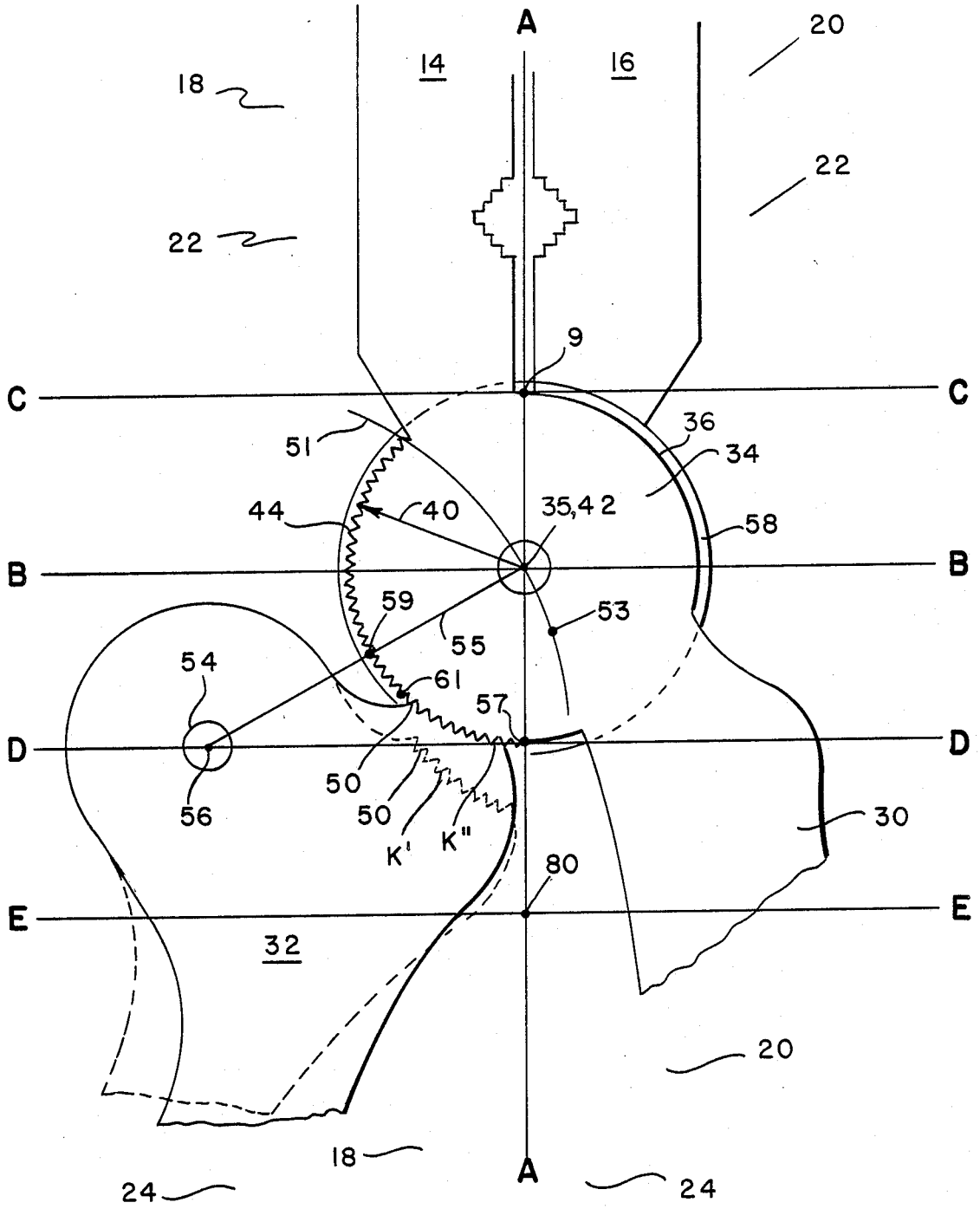
FIG. 4 shows a schematic representation of the top view of the vicinity of the hub of a pair of pliers in accordance with the embodiment of FIG. 1.

The second engaging means 50, as illustrated in FIG. 4, is part of an arc of a circle having a radius substantially equal to the radius 40 of the first hub 34. The first and second positions K' and K" of the second engaging means 50 are the limits of a continuum of intermediate positions located on a continuum of arcs of a first set of circles having radii substantially equal to the radius 40 of the first hub 34, and centers lying on the perimeter 51 of a second circle having as center the center 56 of the second pivoting means 54 and radius the distance 55 between the center 56 of the first pivoting means 54 and the common center point 42. The centers of the first set of circles are also located between the common center point 42 and a point 53, point 53 being the center of a circle on the perimeter of which is located the arc containing the first position K' of the second engaging means 50, in the free open or free closed configuration of the gripping tool.

The gripping tool of this invention, as better illustrated in FIG. 1, has an axis of symmetry A—A, which is perpendicular to the center axes 37 and 48 of the first and the second hubs 34 and 58 respectively, and is parallel to the general direction of the first and second handles 30 and 32, and the first and second jaws 14 and 16 respectively, when the tool is in a free closed or forced closed configuration. The axis of symmetry separates the tool to a left side 18 and to a right side 20. Similarly, an axis of segregation B—B, being perpendicular to the axis of symmetry A—A and passing through the common center point 42, separates the gripping tool to a jaw side 22 and to a handle side 24.

The distance 55 between the center 56 of the second pivoting means 54 and the common center point 42, as better shown in FIG. 4, is preferably larger than 1.2 and smaller than 4 times the radius 40 of the first hub 34. If it is smaller than 1.2 times the radius 40 of the hub 34, the size of the pivoting means 54 and the part of the handle 32 surrounding the pivoting means 54 will necessarily have too small dimensions to withstand the high forces encountered in most applications of the tool. On the other hand, if distance 55 is larger than 4 times the diameter of radius 40 of the first hub 34, then the tool becomes unnecessarily cumbersome.

More preferably, when the gripping tool is at its forced closed configuration, the center 56 of the pivoting mens 54 is also located between two lines C—C and E—E both perpendicular to the axis of symmetry A—A, at the left side 18 of the tool. Line C—C is passing through the intersection 9 of the perimeter 36 of the first hub 34 and the axis of symmetry A—A on the jaw side 22, while line E—E is passing through a point 80 located on the handle side 24 on the axis of symmetry A—A at a distance equal to the diameter (two times the radius 40) of the first hub 34 as measured from the common center point 42.

Even more preferably, when the gripping tool is at its forced closed configuration, the center 56 of the pivoting means 54 is also substantially located on a line D—D, which line is perpendicular to the axis of symmetry A—A and tangent to the perimeter 36 of the first hub 34 at point 57 on the handle side 24.

It is also preferable that, when the gripping tool is at its forced closed configuration, the second engaging means 50 is substantially located on an arc on the perimeter of the first hub 34, the arc extending from the vicinity of a first point 57 to the vicinity of a second point 59. Point 57 is located at the intersection of the axis of symmetry A—A and the perimeter 36 of the first hub 34, while point 59 is located at the intersection of the perimeter 36 of the first hub 34 and a line 55 connecting the center 56 of the second pivoting means 54 with the common center point 42, on the left side 18 of the tool. More preferably, the arc on which lies the second engaging means 50 extends from the vicinity of the first point 57 as described above to the vicinity of a third point 61 located also on the perimeter 36 of the first hub 34 at a distance from the first point 57 equal to ¾ the distance between the first point 57 and the second point 59.

The first and second engaging means 44 and 50 are complementary, which means that they have the same general curvature, the first being convex and the second concave, respectively, as well as such structure so that they can mesh and engage each other, in order to prevent relative motion of the two members 30 and 32 in either direction, when in an engagement mode. If they are sets of complementary teeth, it is important that each set contains a plurality of teeth, the teeth of one set matching with the teeth of the other set.

Figure 10:
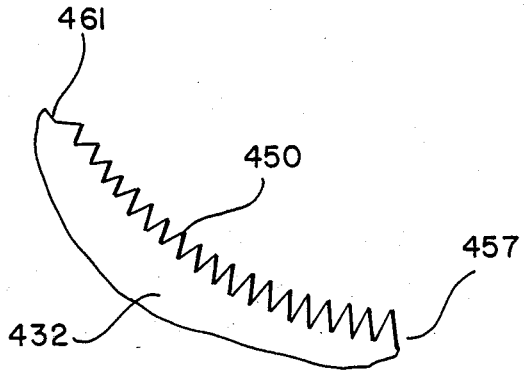
FIG. 10 shows a schematic isolated view of the engaging means located on the handle in accordance with an alternate embodiment of the present invention, where the engaging means include a set of engaging teeth varying in height.

Since the part of teeth closer to point 61 move away from the matching teeth 44 located on the first hub 34 at a slower rate than the part of the teeth located closer to point 57, when the gripping tool starts assuming the free open or free closed configuration from the forced open or the forced closed configuration, it is sometimes beneficial for the smooth operation of the pliers to have the height of the teeth 50 decrease progressively in a direction from point 57 to point 61, without change in the frequency of teeth. A more detailed illustration of this configuration is shown in FIG. 10, where the teeth 450 decrease in height from one end 457 to the other end 461, but retain the size of their width.

At least one of the engaging means may be harder than the main body of the gripping tool, and/or made of hardened metal. Also, at least one of the first and second engaging means may be removable. The removable engaging means may be harder or softer than the rest of the tool. They may be engaging teeth or frictional surfaces. One of the engaging means may be softer and sacrificial to (apt to wear faster than) the other one. Thus, the gripping tool may have one hard engaging means, being either integral part of the gripping tool or being removable, and one softer sacrificial removable one, which when worn can be easily replaced. Of course, when both removable engaging means have substantially the same hardness, each or both can be replaced when they are worn to the point that renders the tool inoperable.

Figure 8:
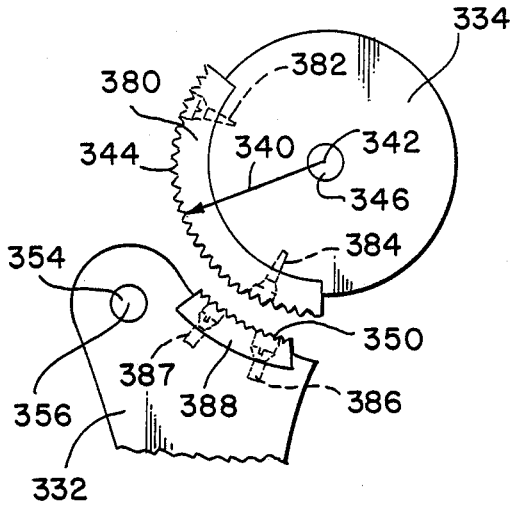
FIG. 8 shows a schematic representation of the vicinity of the hub of a pair of pliers in accordance with the present invention, where the engaging means are removable.
Figure 9:
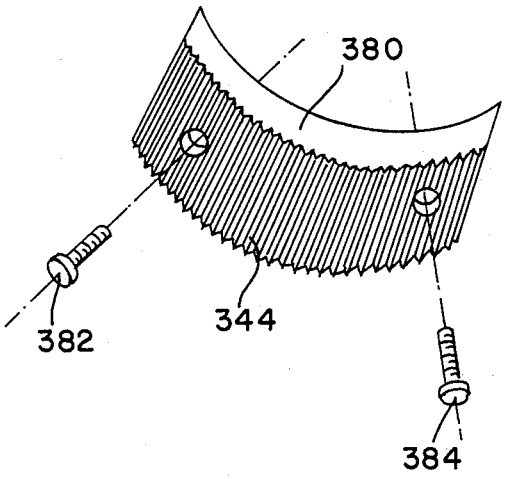
FIG. 9 shows a stylized perspective view of removable engaging means located on the perimeter of the hub used in the embodiment of FIG. 8.

An example where both engaging means are sets of engaging teeth and removable is shown in FIG. 8. In more detail, the first engaging means comprises a removable insert 380 having a set of teeth 344. Insert 380 is attached to hub 334 with screws 382 and 384. Similarly, the second engaging means comprises a removable insert 388 having a set of teeth 350, which are complementary to the teeth of set 344. Insert 350 is attached to second handle 332 with screws 386 and 387. Insert 380 having teeth 344 is shown in an isolated perspective view in FIG. 9. Other fasteners than screws, such as pins, spring pins, and the like may be used to support the removable inserts onto the main body of the tool. In addition, the inserts may be self supported by using press fitting or other techniques well known in the art.

In operation, the pliers are first at rest. In that position, the first bias means 72 presses down on interconnecting arm 52 maintaining the handle 32 connected to the jaw 16 through hub 58 as a single, semi rigid unit which operates to open and close the jaws 14 and 16 by actuating handles 30 and 32 in much the same way as a traditional pair of pliers. The force exerted through bias means 72 is selected sufficient to maintain the handle 32 pivoted around pivoting means 54 and aligned with interconnecting means 52 so that the second engaging means 50 attains a first position K′ spaced away from the first engaging means 44. Upon insertion of an article to be gripped between the jaws 14 and 16 i.e. a nut, and the application of pressure to the handles 30 and 32 urging them toward each other, the second jaw 16 encounters a resistance to its movement toward the first jaw 14 and can move no further. As pressure continues to be applied to the handles, such pressure provides a counter force which eventually overcomes the bias force exerted by the first bias means 72 and pivots the handle 32 around pivoting means 54 so that the second handle 32 comes to rest against first hub 34. In that position, as better shown in FIG. 3, the second engaging means 50 on the second handle 32 attains a second position K″ and engages the first engaging means 44 on first hub 34, effectively locking the two members 10 and 12 together and preventing any further relative movement of the members. As a result, the first and second jaws 14 and 16 are maintained in a fixed position relative to each other, applying a predetermined amount of gripping force to the gripped article as determined by the selection of the bias force rather than the gripping force applied to the pliers handles. Once the pliers have locked they can be used as a wrench. Upon completion of the desired task, as with the traditional pliers the grip on the handles is eased of or released. The bias means 72 again becomes the predominant force between the second handle 33 and the interconnecting arm 52. As a result of this force, the second handle 32 turns around pivoting means 54 and re-aligns with the first interconnecting arm 52 causing the second engaging means 50 to re-assume the first position K' spaced away from the first engaging means 44, thus restoring free movement to the two members.

Figure 5:
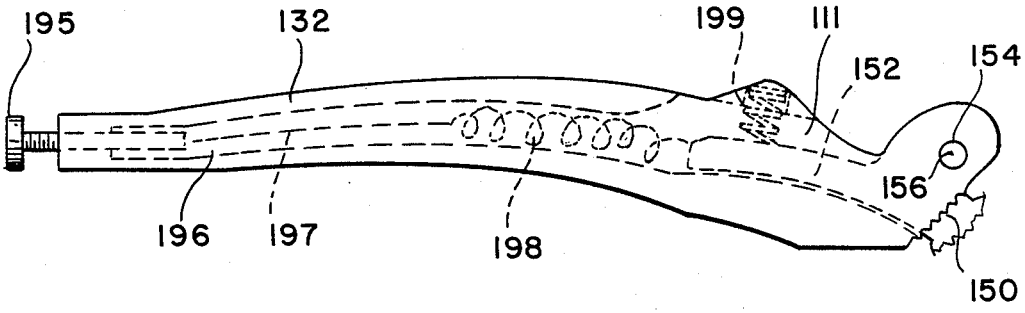
FIG. 5 shows a schematic representation of the top view of a gripping tool according to the present invention, where the bias means comprises an expansion or compression spring.

FIG. 5 shows the top view of an alternate embodiment of the present invention which utilizes an expansion spring 198 as a bias means. The expansion spring 198, contained in a cavity 196 of the second handle 132, is pulled at one end by a string 197 and at the other end by the interconnecting arm 152. The string 197 is connected to a screw 195, preferably through an idle connector. The screw 195 is engaged on that end of the second handle 132 which is opposite to the end containing the second engaging means 150. Thus, expansion spring 198 applies a bias force in order to keep interconnecting arm 152 and handle 132 aligned in a predetermined position with respect to each other. The spring 198 can be also directly connected to the screw 195, or even to the end of handle 132 in the absence of screw 195.

The operation of this embodiment is substantially the same as for the embodiment shown in FIGS. 1 to 4, and described above. Thus, when the tool is at rest, the second handle 132 stays in alignment with interconnecting arm 152 by the pulling bias force of the expansion spring 198. This causes the second engaging means 150 to attain a first position spaced away from the first engaging means located on the first hub. When a gripping force is applied on the handles, which is greater than the pulling bias force exerted by the expansion spring 198, handle 132 deviates from alignment with interconnecting arm 152, so that the second engaging means 150 attains a second position and engages first engaging means located on the first hub. Upon release of the gripping force from the handles, the bias force exerted by the expansion spring becomes predominant again, aligning the interconnecting arm 152 with the second handle 132, and thus causing the second engaging means 150 to reassume the first position spaced away from the first engaging means located on the first hub. The tension of spring 198, and thus the bias force applied between interconnecting arm 152 and handle 132, may be adjusted to a variety of values by turning the screw 195 clockor counterclock-wise.

In still an alternate embodiment of this invention, a compression spring 199, also depicted in FIG. 5, may be used as a first bias means. Compression spring 199, lying within a cavity 111 under a compression mode between the second handle 132 and the first interconnecting means 152, may be used by itself or in combination with other bias means as described above.

The operation of this embodiment is substantially the same as for the embodiments described above. Again, when the tool is at rest, the second handle 132 stays in alignment with interconnecting arm 152 by the compression bias force of the compression spring 199. This causes the second engaging means 150 to attain a first position spaced away from the first engaging means located on the first hub. When a gripping force is applied on the handles, which is greater than the compression bias force exerted by the compression spring 199, handle 132 deviates from alignment with interconnecting arm 152, so that second engaging means 150 attains a second position and engages first engaging means located on the first hub. Upon release of the gripping force from the handles, the bias force exerted by the compression spring 199 becomes predominant again, aligning the interconnecting arm 152 with the second handle 132, and thus causing the second engaging means 150 to reassume the first position spaced away from the first engaging means located on the first hub.

It becomes understood from the above embodiments that the bias means can be any source of permanently applied bias force between the first interconnecting arm and the second handle 32, which tends to automatically align these two parts to a predetermined position with respect to each other. Such sources in addition to mechanical springs, they also include magnetic means, electromagnetic means, and the like.

Figure 6:
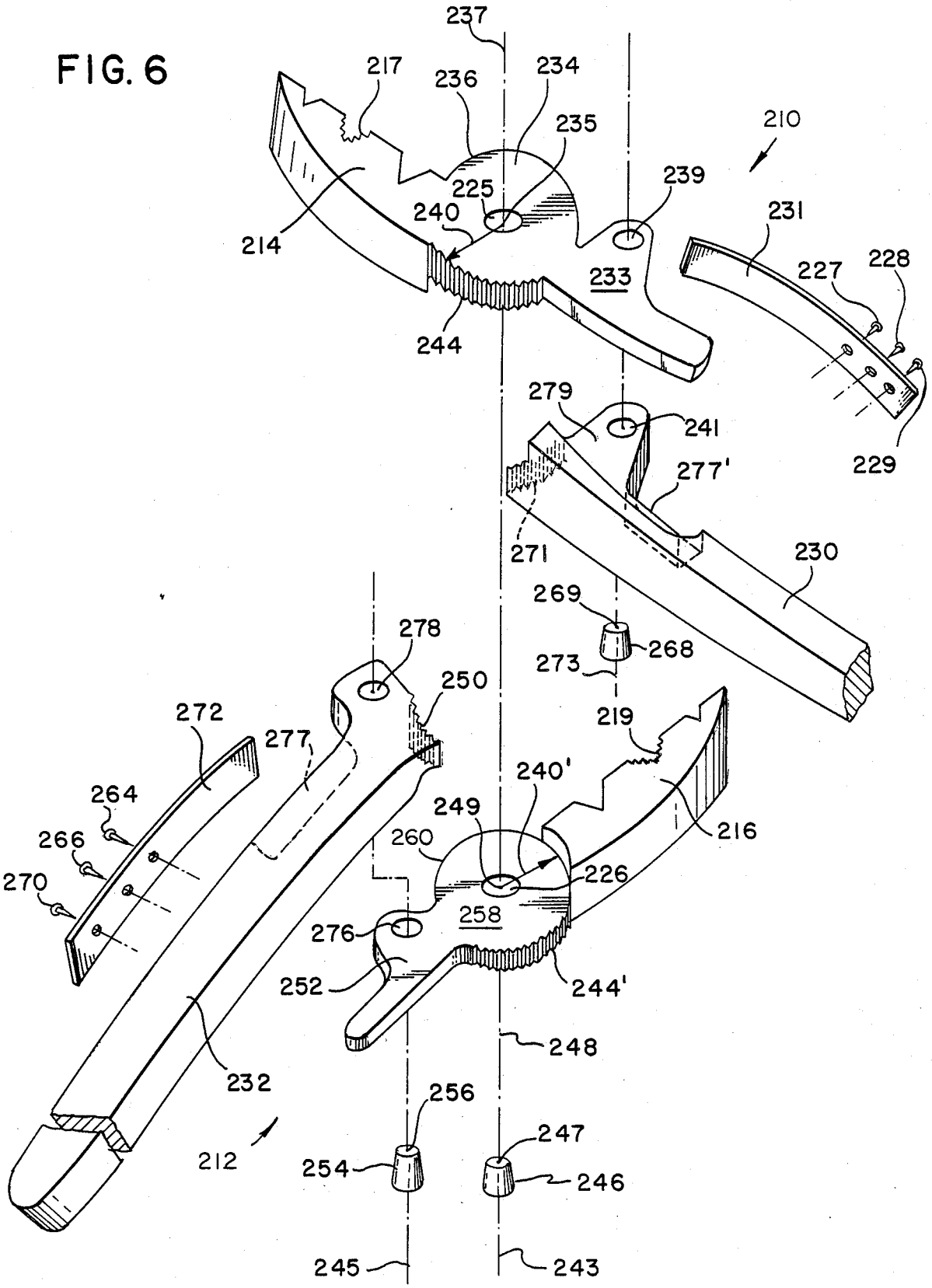
FIG. 6 shows a stylized perspective view of the components of a pair of pliers according to an alternate embodiment of the present invention, which include engaging means on both handles and both hubs.
Figure 7:
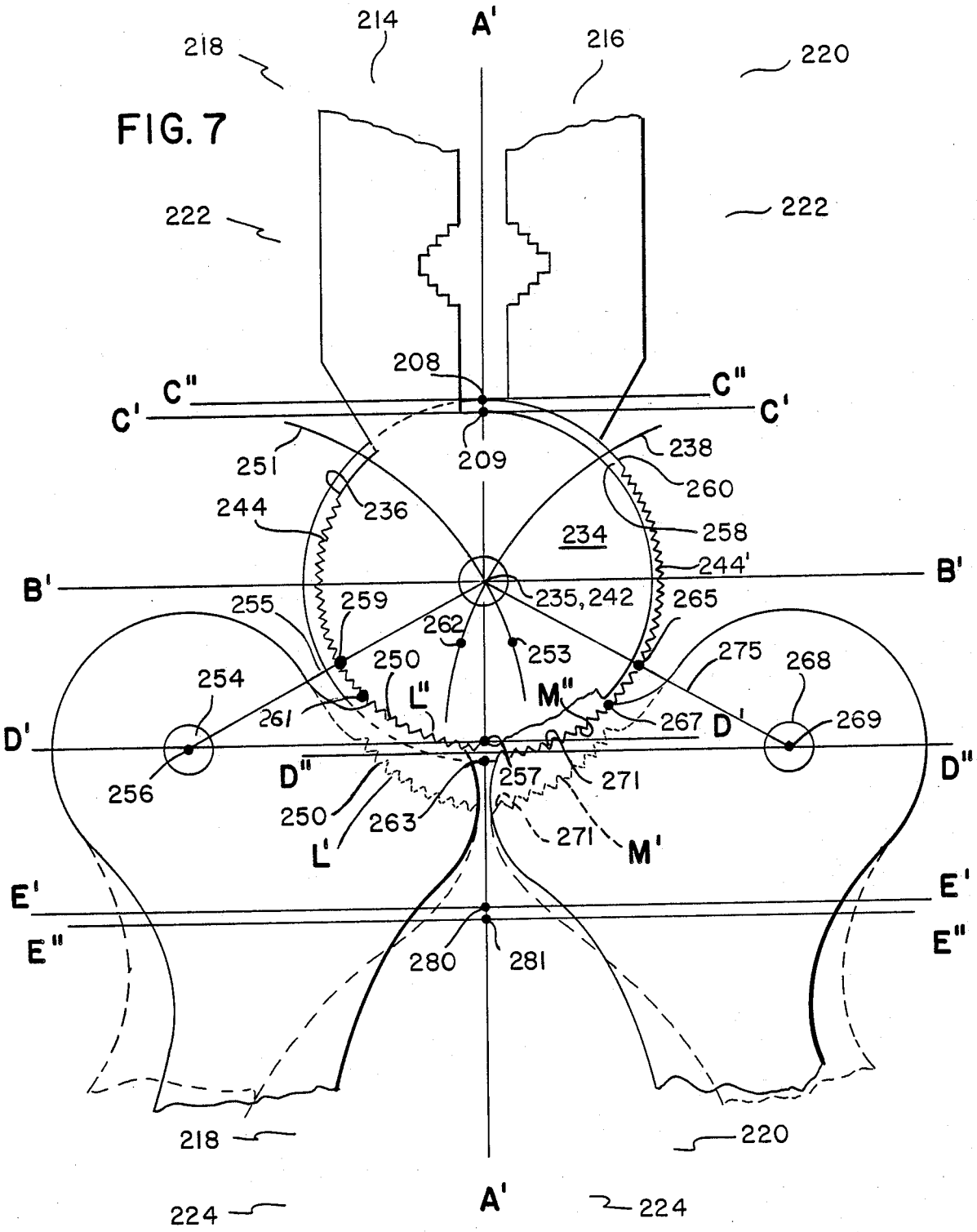
FIG. 7 shows a schematic representation of the top view of the vicinity of the hub of the pair of pliers in accordance with the embodiment of FIG. 6.

In still an alternate embodiment, illustrated in FIGS. 6 and 7, two pairs of complementary engaging means are used to provide a self locking gripping tool according to this invention. In a similar fashion as before, the gripping tool comprises an assembly of a first and a second members 210 and 212 respectively. The first member 210 includes a first jaw 214 extending from a first hub 234, and a second interconnecting arm 233 also extending from the first hub 234 in a direction generally opposite to that of the first jaw 214. The first hub 234, preferably being substantially circular in shape, has a radius 240, a center 235, a center axis 237, a perimeter 236, and a coaxial hole 225. Preferably, hole 225 is conical in shape. Located along the perimeter 236 of the first hub 234, there is a first engaging means 244 which is preferably a set of engaging teeth. The second interconnecting arm 233 includes a hole 239, also preferably conical in shape, which serves to attach the second interconnecting arm 233 to a first handle 230 extending away from the first interconnecting arm 233 in a direction generally opposite to the direction of the first jaw 214.

The first handle 230 includes a cutaway portion 277' into which nests the second interconnecting arm 233. Preferably the cutaway portion 277' of the first handle 230 is shaped such as to match the shape of the second interconnecting arm 233, so that when the arm 233 is nesting in the cutaway portion 277', no part of the arm 233 extends outside of the first handle 230.

In the vicinity of the cutaway portion 277', the first handle 230 includes a hole 241, also preferably conical in shape, so that when the second interconnecting arm 233 and the first handle 230 are rotatably connected by a third pivoting means 268, holes 239 and 241 are parts of the same cone. The third pivoting means 268, which may also be a pin, includes a center 269, and a center axis 273.

A second bias means 231, which may be a leaf spring, is attached to the first handle 230 with one or more screws, such as screws 227, 228, and 229, to apply a second bias force to the second interconnecting arm 233.

The first handle 230 extends close to the second hub 258, where it terminates in a fourth engaging means 271 complementary to the third engaging means 244'. Preferably, the fourth engaging means 271 is also a set of engaging teeth.

The second member 212 has a second jaw 216 extending from a second hub 258. A first interconnecting arm 252 also extends from the second hub 258 in a direction generally opposite to that of the second jaw 216. The second hub 258 also includes a center 249, a center axis 248, and a coaxial hole 226. Preferably, hole 226 is also conical in shape and sized so that when the two members 210 and 212 are assembled into a single unit, they form part of the same cone. Located along the perimeter 260 of the second hub 258, there is a third engaging means 244' which is preferably a set of engaging teeth.

A first pivoting means 246, which may be a pin, includes a center 247, and a center axis 243. The first pivoting means 246 is used to rotatably connect the two members 210 and 212 together. When a pin is employed as the first pivoting means 246, it is preferably conical in shape and sized to fit into the holes 226 and 225, as described in the first embodiment of this invention.

The first interconnecting arm 252 includes a hole 276, also preferably conical in shape, which serves to attach the first interconnecting arm 252 to a second handle 232 extending away from the first interconnecting arm 252 in a direction generally opposite to the direction of the second jaw 216.

The second handle 232 includes a cutaway portion 277 into which nests the first interconnecting arm 252. Preferably the cutaway portion 277 of the second handle 232 is shaped such as to match the shape of the first interconnecting arm 252, so that when the arm 252 is nesting in the cutaway portion, no part of the arm 252 extends outside of the second handle 232.

In the vicinity of the cutaway portion 277, the second handle 232 includes a hole 278, also preferably conical in shape and sized so that when the first interconnecting arm 252 and the second handle 232 are rotatably connected by a second pivoting means 254, holes 278 and 276 are parts of the same cone. The second pivoting means 254, which may also be a pin, includes a center 256, and a center axis 245.

A first bias means 272, which may be a leaf spring, but also a compression spring, an extension spring, or the like, is attached to the second handle 232 with one or more screws, such as screws 264, 266, and 270, to apply a first bias force to the first interconnecting arm 252.

The second handle 232 extends close to the first hub 234, where it terminates in a second engaging means 250 complementary to the first engaging means 244. Preferably the second engaging means 250 may be a set of engaging teeth.

Referring to FIG. 7, a common center point 242 is the projection of a plurality of centers and center axes, shown in detail in FIG. 6, on a plane perpendicular to the center axis of the first pivoting means. These include center 235 and center axis 237 of the first hub 234, center 249 and center axis 248 of the second hub 258, and center 247 center axis 243 of the first pivoting means 246. Similarly, center 269 represents also the projection of center axis 273 of the third pivoting means 268, on a plane perpendicular to center axis 273. In the same way, center 256 represents also the projection of center axis 245 of the second pivoting means 254, on a plane perpendicular to center axis 245.

The gripping tool of this embodiment can also assume four configurations in a similar way as in the case of the embodiments described above. At the free closed configuration, the first and second jaws 214 and 216 are closed or substantially in contact with each other, but no external gripping force has been applied on the handles 230 and 232, so that the second engaging means 250 is pivoted to a first position L' away from the first engaging means 244, and the fourth engaging means 271 is pivoted to a third position M' away from the third engaging means 244'. Forced closed configuration is the configuration that the tool takes when the first and second jaws 214 and 216 are closed or substantially in contact with each other, and adequate gripping force has been applied on the first and second handles 230 and 232 to induce a predetermined counter force against the bias force of the first bias means 272, and against the bias force of the second bias mans 231, so that the second engaging means 250 is pivoted to a second position L", where the second engaging means 250 engages the first engaging means 244, and the fourth engaging means 271 is pivoted to a fourth position M", where the fourth engaging means 271 engages the third pivoting means 244'. When the second engaging means 250 takes position L", each of the engaging means 244 and 250 is said to be in an engagement mode. Also, when the fourth engaging means 271 takes position M", each of the engaging means 244' and 271 is said to be in an engagement position. Similarly, a free open configuration means that the first and second jaws 214 and 216 are open or not in contact with each other and no gripping force has been applied to the handles 230 and 232, so that the second engaging means 250 attains again a first position L' away from the first engaging means 244, and the third engaging means 271 attains a third position M' away from the third engaging means 244'. Finally, the tool is considered to have a forced open configuration when the jaws 214 and 216 are open or not in contact with each other, usually separated by the object to be gripped, and adequate gripping force has been applid on the first and second handles 230 and 232 to induce a predetermined counter force against the bias force of the first bias means 272, and against the bias force of the second bias mans 231, so that the second engaging means 250 is pivoted to a second position L", where the second engaging means 250 engages the first engaging means 244, and the fourth engaging means 271 is pivoted to a fourth position M", where the fourth engaging means 271 engages the third pivoting means 244'.

The second engaging means 250, as illustrated in FIG. 7, is part of an arc of a circle having a radius substantially equal to the radius 240 of the first hub 234. The first and second positions L' and L" of the second engaging means 250 are the limits of a continuum of intermediate positions located on a continuum of arcs of a first set of circles having radii substantially equal to the radius 240 of the first hub 234, and centers lying on the perimeter 251 of a second circle having as center the center 256 of the second pivoting means 254 and radius the distance 255 between the center 256 of the first pivoting means 254 and the common center point 242. The centers of the first set of circles are also located between the common center point 242 and a point 253, point 253 being the center of a circle on the perimeter of which is located the arc containing the first position L' of the second engaging means 250, in the free open or free closed configuration of the gripping tool.

Similarly, the fourth engaging means 271, as illustrated in FIG. 7, is part of an arc of a circle having a radius substantially equal to the radius 240' of the second hub 258. The third and fourth positions M' and M" of the fourth engaging means 271 are the limits of a continuum of intermediate positions located on a continuum of arcs of a first set of circles having radii substantially equal to the radius 240' of the second hub 258, and centers lying on the perimeter 238 of a second circle having as center the center 269 of the third pivoting means 268 and radius the distance 275 between the center 269 of the third pivoting means 268 and the common center point 242. The centers of the first set of circles are also located between the common center point 242 and a point 262, point 262 being the center of a circle on the perimeter of which is located the arc containing the first position M' of the second engaging means 271, in the free open or free closed configuration of the gripping tool.

The gripping tool of this embodiment, as illustrated in FIG. 7, has also an axis of symmetry A'—A', which is perpendicular to the center axes 237 and 248 of the first and the second hubs 234 and 258 respectively, and is parallel to the general direction of the first and second handles 230 and 232, and the first and second jaws 214 and 216 respectively, when the tool is in a free closed or forced closed configuration. The axis of symmetry A'—A' separates the tool to a left side 218 and to a right side 220. Similarly, an axis of segregation B'—B', being perpendicular to the axis of symmetry A'—A' and passing through the common center point 242, separates the gripping tool to a jaw side 222 and to a handle side 224.

The distance 255 between the center 256 of the second pivoting means 254 and the common center point 242 is preferably larger than 1.2 and smaller than 4 times the radius 240 of the first hub 234. Similarly, the distance 275 between the center 269 of the third pivoting means 268 and the common center point 242 is preferably larger than 1.2 and smaller than 4 times the radius 240' of the second hub 258.

More preferably, when the gripping tool is at its forced closed configuration, the center 256 of the pivoting means 254 is also located between two lines C'—C' and E'—E' both perpendicular to the axis of symmetry A'—A', at the left side 218 of the tool. Line C'—C' is passing through the intersection 209 of the perimeter 236 of the first hub 234 and the symmetry of axis A'—A' on the jaw side 222, while line E'—E' is passing through a point 280 located on the handle side 224 on the axis of symmetry A'—A' at a distance equal to the diameter (two times the radius 240) of the first hub 234 as measured from the common center point 242. Similarly, it is more preferable that when the gripping tool is at its forced closed configuration, the center 269 of the pivoting mens 268 is also located between two lines C''—C'' and E''—E'' both perpendicular to the axis of symmetry A'—A', at the right side 220 of the tool. Line C''—C'' is passing through the intersection 208 of the perimeter 260 of the second hub 258 and the symmetry of axis A'—A' on the jaw side 222, while line E''—E'' is passing through a point 281 located on the handle side 224 on the axis of symmetry A'—A' at a distance equal to the diameter (two times the radius 240') of the second hub 258 as measured from the common center point 242.

Even more preferably, when the gripping tool is at its forced closed configuration, the center 256 of the second pivoting means 254 is substantially located on a line D'—D', which line is perpendicular to the axis of symmetry A'—A' and tangent to the perimeter 236 of the first hub 234 at point 257 on the handle side 224. Similarly, it is also even more preferable that, when the gripping tool is at its forced closed configuration, the center 269 of the third pivoting mens 268 is substantially located on a line D''—D'', which line is perpendicular to the axis of symmetry A'—A' and tangent to the perimeter 260 of the second hub 258 at point 263 on the handle side 224.

It is also preferable that, when the gripping tool is at its forced closed configuration, the second engaging means 250 is substantially located on an arc on the perimeter of the first hub 234, the arc extending from the vicinity of a first point 257 to the vicinity of a second point 259. Point 257 is located at the intersection of the axis of symmetry A'—A' and the perimeter 236 of the first hub 234, while point 259 is located at the intersection of the perimeter 236 of the first hub 234 and a line 255 connecting the center 256 of the second pivoting means 254 with the common center point 242, on the left side 218 of the tool. Even more preferably, the arc on which lies the second engaging means 250 extends from the vicinity of the first point 257 as described above to the vicinity of a third point 261 located also on the perimeter 236 of the first hub 234 at a distance from the first point 257 equal to ¾ the distance between the first point 257 and the second point 259. It is also preferable that, when the gripping tool is at its forced closed configuration, the fourth engaging means 271 is substantially located on an arc on the perimeter of the second hub 258, the arc extending from the vicinity of a fourth point 263 to the vicinity of a fifth point 265. Point 265 is located at the intersection of the axis of symmetry A'—A' and the perimeter 260 of the second hub 258, while point 265 is located at the intersection of the perimeter 260 of the second hub 258 and a line 275 connecting the center 269 of the third pivoting means 268 with the common center point 242, on the right side 218 of the tool. Even more preferably, the arc on which lies the second engaging means 271 extends from the vicinity of the fourth point 263 as described above to the vicinity of a sixth point 267 located also on the perimeter 260 of the second hub 258 at a distance from the fourth point 263 equal to ¾ the distance between the fourth point 263 and the fifth point 265.

The four engaging means 244, 250, 268, and 271 of this embodiment may have various hardnesses with respect to the main body of the tool, as well as with respect to each other as described in previous embodiments. Also, at least one may be removable.

The operation of this embodiment is substantially the same as for the previous embodiments. The pliers are first at rest. In that position, the first bias means 272 presses down on first interconnecting arm 252 maintaining the second handle 232 connected to the second jaw 216 through second hub 258 as a single, semi rigid unit. Simultaneously, the second bias means 231 presses down on second interconnecting arm 233 maintaining the first handle 230 connected to the first jaw 214 through the first hub 234 also as a single, semirigid unit. Under these conditions, the gripping tool operates to open and close the jaws 214 and 216 by actuating handles 230 and 232 in much the same way as a traditional pair of pliers. The force exerted through first bias means 272 is selected sufficient to maintain the second handle 232 pivoted around second pivoting means 254 and aligned with first interconnecting arm 252 so that the second engaging means 250 attains a first position L' spaced away from the first engaging means 244. At the same time the force exerted through the second bias means 231 is selected sufficient to maintain the first handle 230 pivoted around the third pivoting means 268 and aligned with the second interconnecting arm 233 so that the fourth engaging means 271 attains a third position M' spaced away from the third engaging means 244'.

Upon insertion of an article to be gripped between the jaws 214 and 216 i.e. a nut, and the application of pressure to the handles 230 and 232 urging them toward each other, the second jaw 216 encounters a resistance to its movement toward the first jaw 214 and can move no further. As pressure continues to be applied to the handles, such pressure provides a counter force which eventually overcomes the first bias force exerted by the first bias means 272 and pivots the second handle 232 around the second pivoting means 254 so that the second handle 232 comes to rest against first hub 234. Such pressure also overcomes the second bias force exerted by the second bias means 231 and pivots the first handle 230 around the third pivoting means 268 so that the first handle 230 comes to rest against the second hub 258

In that position, the second engaging means 250 on the second handle 232 attains a second position L" and engages the first engaging means 244 on first hub 234. At the same time the fourth engaging means 271 on the first handle 230 attains a fourth position M" and engages the third engaging means 244' on the second hub 258. This effectively locks the two members 210 and 212 together and prevents any further relative movement of the members. As a result, the first and second jaws 214 and 216 are maintained in a fixed position relative to each other, applying a predetermined amount of gripping force to the gripped article as determined by the selection of the bias force rather than the gripping force applied to the pliers handles. Once the pliers have locked they can be used as a wrench. Upon completion of the desired task, as with the traditional pliers the grip on the handles is eased of or released.

The first bias means 272 and the second bias means 231 again become the predominant forces between the handles 232 and 230 and the corresponding interconnecting arms 252 and 233, respectively. As a result of this, the second handle 232 turns around the second pivoting means 254 and re-aligns with the first interconnecting arm 252 causing the second engaging means 250 to re-assume the first position L' spaced away from the first engaging means 244. At the same time the first handle 230 turns around third pivoting means 268 and re-aligns with the second interconnecting arm 233 causing the fourth engaging means 271 to re-assume the third position M' spaced away from the third engaging means 244'. Thus, the free movement of the to members 210 and 212 is restored.

As illustrated in FIGS. 1 to 4, the jaws 14 and 16 of the gripping tool may have one or more pairs of cooperating recessed gripping portions 17 and 19. In operation, when the jaws are forced to close, the pairs of recessed gripping portions 17 and 19 grasp the item to be gripped raggedly until the jaws 14 and 16 are allowed to open again, at which point the item is released.

Figure 11:
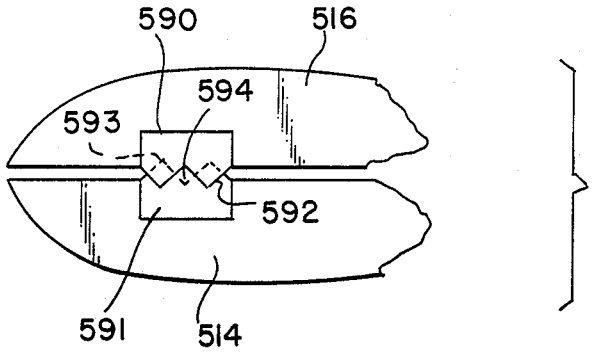
FIG. 11 shows a schematic representation of the jaws in closed position in accordance with an alternate embodiment of the present invention, where the jaws include a pair of cooperating cutting edges.
Figure 12:
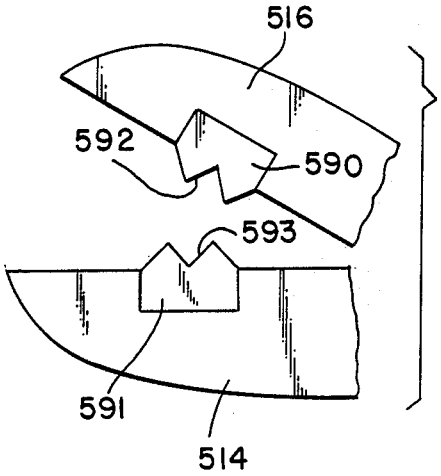
FIG. 12 shows a schematic representation of the jaws of the embodiment of FIG. 11 in open position.
Figure 13:
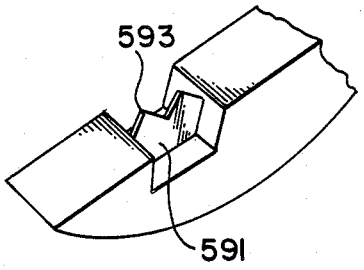
FIG. 13 shows a stylized perspective view of a part of a jaw in accordance with the embodiment of FIGS. 11 and 12.

As better shown in FIGS. 11, 12, and 13, its jaws 514 and 516 may also have one pair or more of cooperating cutting edges 592 and 593, provided by thinner sections of the tool, or inserted blades 590 and 591. The opening 594 left by the cutting edges 592 and 593, when the gripping tool is in its free or forced closed configuration, may vary from zero to any desired size required by the particular design of the tool. Although the cutting edges may be used for any type of controlled cutting, the major application of this embodiment is stripping of electrical wire.

In operation, the wire to be stripped is placed within the cooperating cutting edges 592 and 593. Upon actuation of the handles, the jaws are also urged to close with an adequate force to squeeze and start cutting the insulation until the tool is locked in place at the point when the force applied on the handles exceeds a preselected bias force. As the jaws are maintained at a fixed position after the tool is locked, the cutting process stops within the thickness of the insulation. The wire is then pulled away from the still semi closed cutting edges, thus being freed from the stripped insulation. Upon completion of the stripping task, the grip upon the handles is released.

The particular embodiments discussed above are only given as examples and should not be considered as limiting factors to the scope of the present invention. Although certain combinations of preferred parameters were given as examples, any other combination of the cited parameters lies within the realm of this invention, depending on the application and intended use of the gripping tool.

What I claim is:

1. A gripping tool comprising an assembly of:

(a) a first and a second member;

the first member comprising, a first substantially circular hub having a radius, a center, a center axis, and a perimeter, a first jaw extending from the perimeter of the first hub, a first handle also extending from the perimeter of the first hub in a direction generally opposite to the direction of the first jaw, and first engaging means located along the perimeter of the first hub, for preventing any relative movement of the first and second members with respect to each other, when the first engaging means is in an engagement mode, the second member comprising, a second hub having a center and a center axis substantially coinciding with the center axis of the first hub, a first interconnecting arm integrally connected to the second hub, a second jaw extending from the second hub in a direction generally opposite to the direction of the first interconnecting arm, a second handle extending away from the first interconnecting arm in a direction generally opposite to the direction of the second jaw, and second engaging means on the second handle along a concave curvature, the concave curvature being part of an arc of a circle of a radius substantially equal to the radius of the first hub, the second engaging means being complementary to the first engaging means, (b) first pivoting means having a center and a center axis for rotatably connecting the first and the second hubs through their center axes, whereby the handles are pivoted from a free open to a forced closed configuration where the first and second jaws are substantially in contact with each other, and the first and second engaging means are also in contact with each other, for preventing any relative movement of the first and second members with respect to each other, when the second engaging means is in an engagement mode, (c) second pivoting means having a center and a center axis for rotatably connecting the second handle to the first interconnecting arm and (d) first spring bias means for applying a first bias force between the first interconnecting arm and the second handle in order to maintain the second engaging means to a first position spaced away from the first engaging means, the first bias force selected such that upon application of a predetermined counter force to the first spring bias means, the second engaging means pivots to a second position and engages the first engaging means preventing any relative movement of the first and second members until such time as the predetermined force is removed from the first spring bias means, the first and second positions of the second engaging means being the limits of a continuum of intermediate positions located on a continuum of arcs of a first set of circles having radii equal to the radius of the first hub and centers lying on the perimeter of a second circle having as center the center of the second pivoting means and radius the distance between the centers of the first and second pivoting means, the gripping tool also having:

a common center point substantially coinciding with the projection of the centers and the center axes of the first and second hubs and the first pivoting means on a plane perpendicular to the center axes of the first and second hubs and the first pivoting means, an axis of symmetry perpendicular to the center axes of the first and the second hubs, and parallel to the general direction of the first and second jaws and the first and second handles when the gripping tool is in the forced closed configuration, the axis of symmetry also separating the gripping tool into a left side and to a right side, and an axis of segregation perpendicular to the axis of symmetry and passing through the common center, the axis of segregation separating the gripping tool to a jaw side and to a handle side.

2. A gripping tool in accordance with claim 1, wherein the distance between the common center and the center of the second pivoting means is less than 4 times and more than 1.2 times the radius of the first hub.

3. A gripping tool in accordance with claim 2, wherein at the forced closed configuration, the center of the second pivoting means lies at the left side between two lines perpendicular to the axis of symmetry, one line passing through a point located at the intersection of the perimeter of the first hub and the axis of symmetry on the jaw side, and the other line passing through a point located on the handle side of the axis of symmetry at a distance equal to the diameter of the first hub, the distance measured from the center of the first hub.

4. A gripping tool in accordance with claim 3, wherein at the forced closed configuration, the center of the second pivoting means lies substantially on a line perpendicular to the axis of symmetry and tangent to the perimeter of the first hub on the handle side.

5. A gripping tool in accordance with claim 3, wherein at the forced closed configuration, the second engaging means is substantially located within an arc on the perimeter of the first hub, the arc extending from the vicinity of a first point located at the intersection of the axis of symmetry and the perimeter of the first hub on the handle side to a second point at the intersection of the perimeter of the first hub and a line connecting the centers of the first and second pivoting means, on the left side.

6. A gripping tool in accordance with claim 5, wherein at the forced closed configuration, the second engaging means is substantially located within an arc on the perimeter of the first hub, the arc extending from the vicinity of the first point to the vicinity of a third point also on the perimeter of the first hub at a distance from the first point equal to $\frac{3}{4}$ of the arc distance between the first and the second points.

7. A gripping tool in accordance with claim 1 or 6, wherein the first engaging means comprises a first set of engaging teeth, and the second engaging means comprises a second set of engaging teeth.

8. A gripping tool in accordance with claim 7, wherein the tooth height of the second set of engaging teeth decreases in the direction from the first point to the third point.

9. A gripping tool in accordance with claim 1 or 6, wherein at least one of the first and second engaging means is harder than the body of the gripping tool.

10. A gripping tool in accordance with claim 9, wherein at least one of the first and second engaging means is hardened metal.

11. A gripping tool in accordance with claim 1 or 6, wherein at least one of the first and second engaging means is removable.

12. A gripping tool in accordance with claim lor 6, wherein the first and second engaging means comprise frictional surfaces.

13. A gripping tool in accordance with claim 1 or 6, wherein the first spring bias means is adjustable.

14. A gripping tool in accordance with claim lor 6, wherein the first spring bias means comprises a leaf spring.

15. A gripping tool in accordance with claim 1 or 6, wherein the first spring bias means comprises a compression spring.

16. A gripping tool in accordance with claim 1 or 6, wherein the first spring bias means comprises an expansion spring.

17. A gripping tool in accordance with claim 1, wherein the second hub is substantially circular, also having a radius and a perimeter, the gripping tool further comprising:

third engaging means located along the perimeter of the second hub, for preventing any relative movement of the first and second members with respect to each other, when the third engaging means is in an engagement mode, a second interconnecting arm integrally connected to the first hub, fourth engaging means on the first handle along a concave curvature, the concave curvature being part of an arc of a circle having a radius equal to the radius of the second hub, for preventing any relative movement of the first and second members with respect to each other, when the fourth engaging means is in an engagement mode, third pivoting means having a center and a center axis for rotatably connecting first handle to the second interconnecting arm, and second spring bias means for applying a second bias force between the second interconnecting arm and the first handle in order to maintain the fourth engaging means to a third position spaced away from the third engaging means, the second bias force selected such that upon application of a predetermined counter force to the second spring bias means, the fourth engaging means pivots to a fourth position and engages the third engaging means preventing any relative movement of the members until such time as the predetermined force is removed from the second spring bias means, the third and fourth positions of the fourth engaging means being the limits of a continuum of intermediate positions located on a continuum of arcs of a third set of circles having radii equal to the radius of the second hub and centers lying on the perimeter of a fourth circle having as center the center of the third pivoting means and radius the distance between the center axis of the third pivoting means and the center axis of the second hub.

18. A gripping tool in accordance with claim 17, wherein the distance between the common center and the center of the third pivoting means is less than 4 times and more than 1.2 times the radius of the second hub.

19. A gripping tool in accordance with claim 18, wherein at the forced closed configuration, the center of the third pivoting means lies at the right side between two lines perpendicular to the axis of symmetry, one line passing through a point located at the intersection of the perimeter of the second hub and the axis of symmetry on the jaw side, and the other line passing through a point located on the handle side of the axis of symmetry at a distance equal to the diameter of the second hub, the distance measured from the center of the second hub.

20. A gripping tool in accordance with claim 19, wherein at the forced closed configuration, the center of the third pivoting means lies substantially on a line perpendicular to the axis of symmetry and tangent to the perimeter of the second hub on the handle side.

21. A gripping tool in accordance with claim 19, wherein at the forced closed configuration, the fourth engaging means is substantially located within an arc on the perimeter of the second hub, the arc extending from the vicinity of a fourth point located at the intersection of the axis of symmetry and the perimeter of the second hub on the handle side to a fifth point at the intersection of the perimeter of the second hub and the line connecting the centers of the first and the third pivoting means, on the right side.

22. A gripping tool in accordance with claim 21, wherein at the forced closed configuration, the fourth engaging means is substantially located within an arc on the perimeter of the second hub, the arc extending from the vicinity of the fourth point to the vicinity of a sixth point also on the perimeter of the second hub at a distance from the fourth point equal to $\frac{3}{4}$ of the arc distance between the fourth and the fifth points, on the right side.

23. A gripping tool in accordance with claim 17, wherein the third engaging means comprises a third set of engaging teeth, and the fourth engaging means comprises a fourth set of engaging teeth.

24. A gripping tool in accordance with claim 23, wherein the tooth height of the fourth set of engaging teeth decreases in the direction from the fourth point to the sixth point.

25. A gripping tool in accordance with claim 17, wherein at least one of the third and fourth engaging means is harder than the body of the gripping tool.

26. A gripping tool in accordance with claim 25, wherein at least one of the third and fourth engaging means is hardened metal.

27. A gripping tool in accordance with claim 17, wherein at least one of the third and fourth engaging means is removable.

28. A gripping tool in accordance with claim 17, wherein the third and fourth engaging means comprise frictional surfaces.

29. A gripping tool in accordance with claim 17, wherein the second spring bias means is adjustable.

30. A gripping tool in accordance with claim 17, wherein the second spring bias means comprises a leaf spring.

31. A gripping tool in accordance with claim 17, wherein the second spring bias means comprises a compression spring.

32. A gripping tool in accordance with claim 17, wherein the second spring bias means comprises a expansion spring.

33. A tool in accordance with claim 1 or 6 or 17, wherein the first and second jaws have at least one pair of cooperating gripping recessed portions.

34. A gripping tool in accordance with claim 1 or 6 or 17, wherein the first and second jaws have at least one pair of cooperating cutting edges.

* * * * *